US008933311B2

(12) United States Patent
Hashimoto

(10) Patent No.: US 8,933,311 B2
(45) Date of Patent: Jan. 13, 2015

(54) SNARE DRUM

(71) Applicant: Yamaha Corporation, Hamamatsu-Shi, Shizuoka-Ken (JP)

(72) Inventor: Ryuji Hashimoto, Hamamatsu (JP)

(73) Assignee: Yamaha Corporation, Hamamastu-Shi, Shizuoka-Ken (JP)

( * ) Notice: Subject to any disclaimer, the term of this patent is extended or adjusted under 35 U.S.C. 154(b) by 0 days.

(21) Appl. No.: 13/945,385

(22) Filed: Jul. 18, 2013

(65) Prior Publication Data

US 2014/0026733 A1 Jan. 30, 2014

(30) Foreign Application Priority Data

Jul. 27, 2012 (JP) ..... 2012-166708

(51) Int. Cl.
*G10D 3/00* (2006.01)
*G10D 13/02* (2006.01)

(52) U.S. Cl.
CPC ..... *G10D 13/025* (2013.01); *G10D 13/027* (2013.01)
USPC ..... 84/411 R

(58) Field of Classification Search
CPC ..... G10D 13/02; G10D 13/027; G10D 13/00
USPC ..... 84/411 R, 415–417
See application file for complete search history.

(56) References Cited

U.S. PATENT DOCUMENTS

| | | | | |
|---|---|---|---|---|
| 5,844,157 | A * | 12/1998 | Kasha | 84/415 |
| 6,245,979 | B1 * | 6/2001 | Campbell | 84/411 M |
| 6,525,249 | B1 | 2/2003 | Suenaga | |
| 6,784,352 | B2 | 8/2004 | Suenaga | |
| 6,949,701 | B2 | 9/2005 | Okumura | |
| 7,642,439 | B2 | 1/2010 | Fujii | |
| 8,294,013 | B2 * | 10/2012 | Lento | 84/411 R |
| 2013/0042744 | A1 | 2/2013 | Hsien | |

FOREIGN PATENT DOCUMENTS

| | | | |
|---|---|---|---|
| JP | 11-219168 | A | 8/1999 |
| JP | 3656633 | B2 | 6/2005 |
| JP | 3835084 | B2 | 10/2006 |
| JP | 2007-072300 | A | 3/2007 |
| JP | 2007-156048 | A | 6/2007 |

* cited by examiner

*Primary Examiner* — Kimberly Lockett
(74) *Attorney, Agent, or Firm* — Dickstein Shapiro LLP

(57) ABSTRACT

A snare drum 10 has a hollow cylindrical shell 11, a batter head 12 mounted on one end of the shell 11, a snare side head 13 mounted on the other end of the shell 11 and a snare wire 14 whose both ends are held by the both sides of the shell 11 to span across the surface of the snare side head 13. The snare side head 13 has a plurality of through-holes 13*c*. As a result, the snare drum 10 reduces sound volume while maintaining natural timbre and feeling of striking a snare drum.

9 Claims, 6 Drawing Sheets

(a)

(b)

SNARE DRUM

BACKGROUND OF THE INVENTION

1. Field of the Invention

The present invention relates to a snare drum with reducing sound volume.

2. Description of the Related Art

Acoustic drums are musical instruments which generate loud sound. Depending on the venue where the acoustic drums are played, therefore, the sound volume of the acoustic drums are too loud. In some cases, furthermore, acoustic drums are adjusted to reduce the sound volume of the acoustic drums due to significant differences in sound volume between the other musical instruments. Conventionally, therefore, a head member of a surface where a player strikes are replaced with a mesh head, or a rubber pad is provided on a head member to reduce sound volume. An example of such conventional drums is a drum whose head member has a multiplicity of through-holes to reduce sound volume (for example, see Japanese Patent Publication No. 3835084).

This drum has a hollow cylindrical shell and a sheet-type head member provided on an upper opening of the shell. The sheet-type head member is equipped with a punched sheet having a multiplicity of through-holes. The drum having the head member produces smaller bounce at a strike on the head member than a drum having a mesh head member. Therefore, the conventional drum having the sheet-type head member is capable of reducing sound volume, resembling the feeling of striking a normal acoustic drum.

SUMMARY OF THE INVENTION

In a case where the head member having the multiplicity of through-holes and applied to the conventional drum is used as a batter head of a snare drum, however, it is hard to convey air and sound pressure to a snare side head and a snare wire even though the batter head is displaced and vibrated by strikes on the batter head with sticks. Therefore, the conventional snare drum can hardly generate sound peculiar to snare drum which should be brought about by the snare side head and the snare wire. Due to the multiplicity of through-holes provided on the batter head, furthermore, the vibrations of the batter head quickly decay, so that the air traveled to the snare side head and the snare wire will not persist to fail to realize natural sustain which should be realized by a snare drum.

Furthermore, behaviors of the batter head in response to a strike on the batter head with a stick vary depending on whether or not the batter head has through-holes. Due to the multiplicity of through-holes provided on the batter head, therefore, the conventional snare drum having the through-holes provides a player with feeling and touch which are different from the feeling and touch provided by normal snare drums. Therefore, the snare drum having the batter head of the head member having the multiplicity of through-holes is disadvantageous in that the snare drum can be used for practice, but cannot be used for actual music performance. Furthermore, the snare drum is also disadvantageous in that the multiplicity of through-holes provided on the batter head which will be struck significantly degrade durability of the batter head.

The present invention was accomplished to solve the above-described problems, and an object thereof is to provide a snare drum which can maintain timbres and feeling which should be provided by snare drums and can also reduce sound volume. As for descriptions for respective constituents of the present invention described below, numbers corresponding to components of a later-described embodiment are given in parenthesis for easy understanding. However, the respective constituents of the present invention are not limited to the corresponding components indicated by the numbers of the embodiment.

In order to achieve the above-described object, it is a feature of the present invention to provide a snare drum including a hollow cylindrical shell (11); a batter head (12) mounted on one end of the hollow cylindrical shell; a snare side head (13, 23, 33, 43, 53) mounted on the other end of the hollow cylindrical shell, the snare side head having a plurality of through-holes (13*c*, 23*c*, 33*c*, 43*c*, 43*d*, 53*c*); and a snare wire (14) adapted to vibrate on the snare side head. In this case, for example, the batter head is a surface which is to be struck and the snare wire moves toward and away from the snare side head. The batter head may have no through-holes. Furthermore, the through-holes may be arranged in a triangular lattice pattern.

The snare drum according to the present invention has the through-holes on the snare side head. In response to a strike on the batter head, therefore, the batter head behaves similarly to the batter head of a conventional snare drum to keep vibrating, while the snare side head and the snare wire vibrate with reduced amplitude but keep vibrating. Therefore, the snare drum according to the present invention can provide natural timbre and sustain of snare drum produced by a collision of the snare wire with the snare side head.

Furthermore, because the batter head is similar to a conventional batter head, the feeling and touch of striking the batter head are similar to the feeling and touch of striking a normal snare drum. In addition, because a conventional snare drum can be used only by replacing a snare side head with the snare side head of the invention, the tension of the batter head, the tension of the snare side head and the tension of the snare wire can be tuned in the same way as the conventional snare drum. As described above, the snare drum according to the present invention can reduce only the sound volume, maintaining natural timbre and sustain of sound of snare drum. Furthermore, the durability of the batter head will not be decreased.

It is another feature of the snare drum according to the present invention that the through-holes (13*c*, 33*c*, 43*c*, 43*d*, 53*c*) are provided only on an area of the snare side head (13, 33, 43, 53) which does not face the snare wire. In this case, for example, the area provided with the through-holes is an area of the snare side head which excludes an area facing the snare wire and extending in a radial direction through a midpoint of the snare side head to have a width approximately equal to a width of the snare wire. According to the snare drum having the feature, the durability of the area having no through-holes is equivalent to the durability of a conventional snare side head.

It is still another feature of the snare drum according to the present invention that the through-holes (23*c*) include a first group of through-holes provided on an area of the snare side head which faces the snare wire and a second group of through-holes provided on an area of the snare side head which does not face the snare wire, wherein a density of the first group of through-holes is different from a density of the second group of through-holes. In this case, for example, the area provided with the first group of through-holes is an area of the snare side head which faces the snare wire and extends in a radial direction through a midpoint of the snare side head to have a width approximately equal to a width of the snare wire. The area provided with the second group of through-holes is an area of the snare side head which excludes the area provided with the first group of through-holes. The density of the first group of through-holes may be less than the density of the second group of through-holes. Therefore, the snare drum having the feature can vary the advantageous effect of reducing sound volume and the advantageous effect on durability as desired.

It is a further feature of the snare drum according to the present invention that the through-holes (23*c*) include a first group of through-holes provided on an area of the snare side head which faces the snare wire and a second group of through-holes provided on an area of the snare side head which does not face the snare wire, wherein a diameter of the first group of through-holes is different from a diameter of the second group of through-holes. In this case, for example, the area provided with the first group of through-holes is also an area of the snare side head which faces the snare wire and extends in a radial direction through a midpoint of the snare side head to have a width approximately equal to a width of the snare wire. The area provided with the second group of through-holes is also an area of the snare side head which excludes the area provided with the first group of through-holes. The diameter of the first group of through-holes is less than the diameter of the second group of through-holes. Therefore, the snare drum having the feature can also vary the advantageous effect of reducing sound volume and the advantageous effect on durability as desired.

It is a still further feature of the snare drum according to the present invention that the through-holes (43*c*, 43*d*, 53*c*) are provided on a center area and an outer area of the snare side head (43, 53), wherein a density of through-holes provided on the center area is different from a density of through-holes provided on the outer area. The snare drum having the feature can vary the timing when sound generated by the snare drum decay, and can vary the degree of reduction in amplitude of the sound. Therefore, the present invention can realize the snare drum which generates desired timbre.

It is another feature of the snare drum according to the present invention that the through-holes (43*c*, 43*d*) are provided on a center area and an outer area of the snare side head (43), wherein a diameter of through-holes provided on the center area is different from a diameter of through-holes provided on the outer area. The snare drum having the feature can also vary the decay and the amplitude of sound generated by the snare drum. Therefore, the present invention can realize the snare drum which generates sound of desired decay and amplitude.

In the present invention, it is preferable that the diameter of the through-holes is 0.5 to 5 mm while the through-hole rate of the through-holes with respect to the snare side head is 0.5 to 6%. According to the present invention configured as above, a common snare drum such as a snare drum having a diameter of 13 inches or 14 inches can be a favorable snare drum which generates natural timbre of snare drum. Furthermore, the through-hole rate of the through-holes with respect to the snare side head indicates the total area of all the through-holes with respect to the area of a shell opening on which the snare side head is mounted. Furthermore, by providing various snare side heads of different diameters and different through-hole rates of the through-holes, a player can choose a snare drum of desired sound volume and desired timbre to realize desired performance.

DESCRIPTION OF THE PREFERRED EMBODIMENT

First Embodiment

Figure 1:
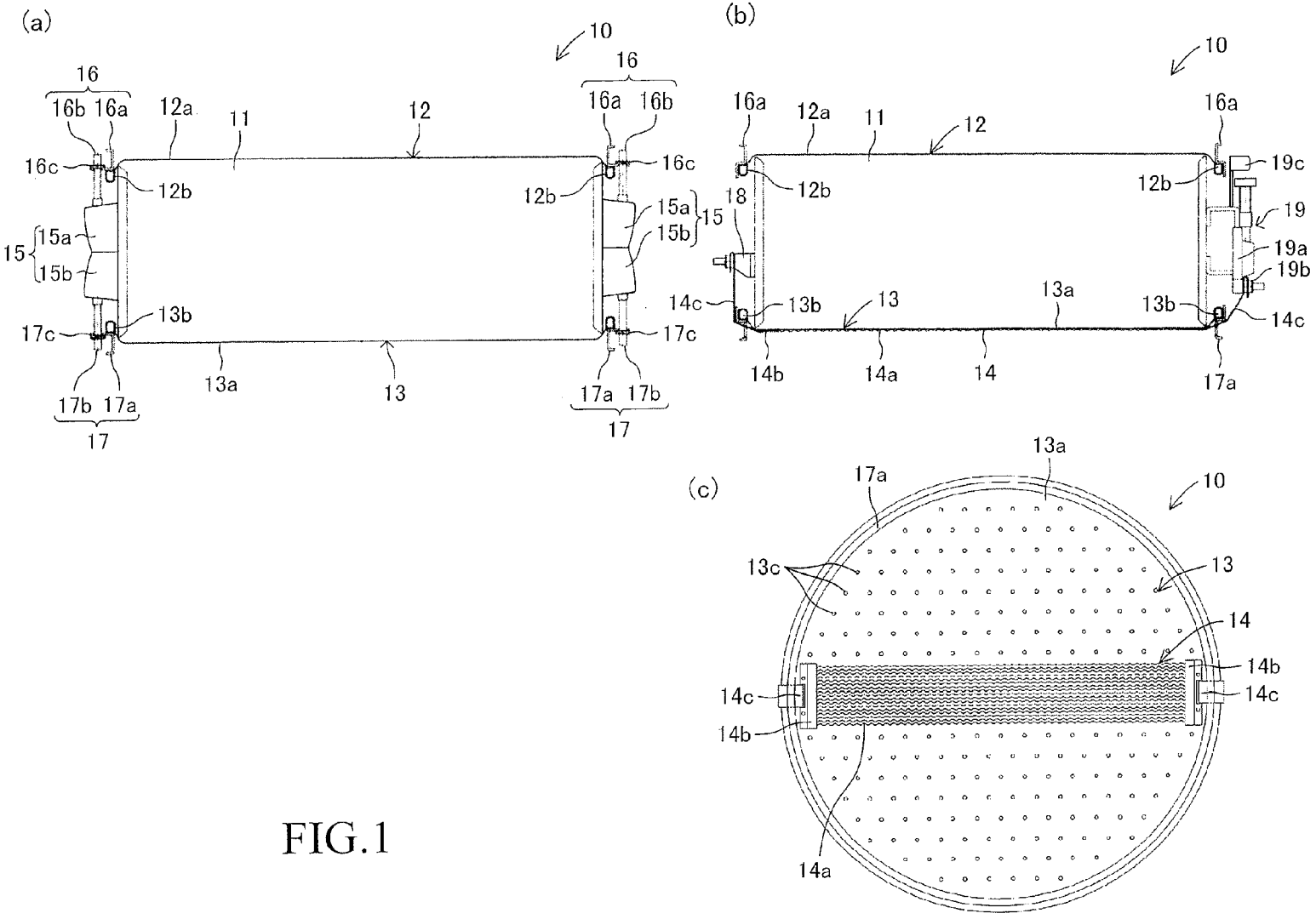
FIG. 1 indicates a snare drum according to the first embodiment of the present invention, and more specifically, FIG. 1(*a*) is a front view, FIG. 1(*b*) is a side view, and FIG. 1(*c*) is a bottom view.

Hereafter, a snare drum according to the first embodiment of the present invention will be described with reference to the drawings. FIGS. 1 (*a*) to (*c*) show a snare drum 10 according to the embodiment. The snare drum 10 is a snare drum measuring 14 inches in diameter, and has a hollow cylindrical shell 11 which is a drum shell, a circular batter head 12 mounted on an upper opening (one end) of the shell 11, a circular snare side head 13 mounted on a lower opening (the other end) of the shell 11, and a snare wire 14 mounted on the bottom surface of the snare side head 13.

The shell 11 is made of wood (birch) and has functions of efficiently conveying internal air downward when vibrations occur and of reverberating the vibrations inside the shell 11. The batter head 12 is formed of a circular head portion 12*a* made of a PET (polyethylene terephthalate) film and a flesh hoop 12*b* which is a metal ring. The head portion 12*a* has a thickness of 250 μm, and has a slightly larger diameter than the diameter of the upper opening of the shell 11. The head portion 12*a* is kept circular by connecting the outer edge of the head portion 12*a* with the flesh hoop 12*b*, while the head portion 12*a* is stretched over the upper opening of the shell 11 by lugs 15 and an upper stretching portion 16 to form a surface on which a player strikes. The internal diameter of the flesh hoop 12*b* is slightly larger than the outer diameter of the shell 11, so that when the upper portion of the shell 11 is placed within the flesh hoop 12*b*, the outer edge of the head portion 12*a* is pressed against the opening edge of the shell 11.

The lugs 15 are vertically long members whose vertical length is approximately ½ of the vertical length of the shell 11, and are fixed at the center in the vertical direction of the outer peripheral surface of the shell 11. The lugs 15 are provided around the shell 11 at regular intervals. Each lug 15 is integrally formed of vertically symmetrical upper lug portion 15*a* and lower lug portion 15*b*. Furthermore, a screw hole is internally provided downward from the top side of each upper lug portion 15*a*, while a screw hole is internally provided upward from the bottom side of each lower lug portion 15*b*.

The upper stretching portion 16 is formed of a hoop 16*a* and tuning bolts 16*b*. The hoop 16*a* is shaped like a stepwise ring whose diameter is larger in a lower portion of the hoop 16*a* than in an upper portion. More specifically, the hoop 16*a* is designed such that the outer peripheral surface and the top surface of the flesh hoop 12*b* are covered with the lower portion of the hoop 16*a*, and the internal diameter of the upper portion is approximately the same as the internal diameter of the flesh hoop 12*b*. At an outer peripheral portion of the larger lower portion of the hoop 16*a*, engaging projections 16*c* each having a bolt-inserting hole is provided, so that as many engaging projections 16*c* as the lugs 15 are provided around the hoop 16*a* at regular intervals. Each tuning bolt 16*b* is formed of a thread portion which can be inserted into the bolt-inserting hole of the engaging projection 16*c* and can be engaged in the screw hole of the upper lug portion 15*a*, and a head portion whose diameter is larger than the diameter of the bolt-inserting hole of the engaging projection 16*c* so that the head portion cannot be inserted in the bolt-inserting hole of the engaging projection 16*c*. Therefore, the snare drum is provided with as many tuning bolts 16*b* as the lugs 15.

Therefore, the batter head 12 is fixed to the shell 11 by mounting the batter head 12 on the top of the shell 11 so that in a state where the engaging projections 16*c* face the lugs 15, respectively, the hoop 16*a* will be placed above the flesh hoop 12*b* to insert the thread portions of the respective tuning bolts 16*b* into the bolt-inserting holes of the engaging projections 16*c* to engage the thread portions in the screw holes of the upper lug portions 15*a*. By adjusting the tightness of the tuning bolts 16*b*, the tension of the batter head 12 can be adjusted. In this case, the upper portion of the hoop 16*a* protrudes above the head portion 12*a* of the batter head 12 so that a player can hit the upper portion of the hoop 16*a* with a shoulder portion of a stick S (see FIG. 2).

The snare side head 13 is formed of a circular head portion 13*a* made of a PET film and a flesh hoop 13*b* which is a metal ring. The head portion 13*a* has a thickness of 75 μm, and has a slightly larger diameter than the diameter of the lower opening of the shell 11. On the head portion 13*a*, a plurality of circular through-holes 13*c* measuring 3 mm in diameter are provided, avoiding a belt-like area (an area hidden by the snare wire 14 in FIG. 1(*c*)) extending in a radial direction through the midpoint. The through-holes 13*c* are arranged in 20 mm pitch. In a state shown in FIG. 1(*c*), more specifically, vertically arranged lines of the through-holes 13*c* are displaced alternately in a horizontal direction to form a two-dimensional close-packed arrangement of triangular lattice. In other words, the through-holes 13*c* are arranged in a triangular lattice pattern. As for the snare side head 13, the through-hole rate of the through-holes 13*c* is 2%. More specifically, the total area of the through-holes 13*c* is 2 percent of the entire area of the snare side head 13.

Similarly to the batter head 12, the snare side head 13 is kept circular by connecting the outer edge of the snare side head 13 with the flesh hoop 13*b*, while the snare side head 13 is attached to the lower opening of the shell 11 by the lower lug portions 15*b* of the lugs 15 and a lower stretching portion 17. The lower stretching portion 17 is formed of a hoop 17*a* and tuning bolts 17*b*. The hoop 17*a* is designed such that the hoop 16*a* is arranged upside down while through-holes into which bolts will be inserted, respectively, are provided at counterparts of the upper edge of the hoop 17*a*. The tuning bolts 17*b* are configured similarly to the tuning bolts 16*b*, so that there are as many tuning bolts 17*b* as the tuning bolts 16*b*.

By use of the lower lug portions 15*b* and the lower stretching potion 17, the snare side head 13 is fixed to the lower portion of the shell 11 similarly to the above-described batter head 12. In this case as well, the thread portions of the respective tuning bolts 17*b* are inserted into the bolt-inserting holes of engaging projections 17*c* provided on the hoop 17*a* to engage the thread portions in the screw holes of the lower lug portions 15*b*. By adjusting the tightness of the tuning bolts 17*b*, the tension of the snare side head 13 can be adjusted.

The snare wire 14 is coiled snare wires formed by connecting both ends of a plurality of metal coils 14*a* to a pair of metal snare plates 14*b*. When the pair of snare plates 14*b* are pulled each other so that the snare plates 14*b* are away from each other, the coils 14*a* extend. When the pair of snare plates 14*b* are released, the coils 14*a* shrink to return to the original state. The snare wire 14 is mounted on the shell 11 by a pair of belt-like snare chords 14*c*, a fixed strainer 18 and a movable strainer 19. One end of each snare chord 14*c* can be detached/attached from/to its corresponding snare plate 14*b*. The fixed strainer 18 is fixed between two of the lugs 15 provided on the outer peripheral surface of the shell 11 so that the other end of one of the snare chords 14*c* will be fixed to the fixed strainer 18.

The movable strainer 19 is placed on a position of the outer peripheral surface of the shell 11 so that the position will be opposite to the position where the fixed strainer 18 is placed. The movable strainer 19 is formed of a supporting portion 19*a*, a snare holding plate 19*b*, a lever 19*c* and the like which are fixed to the outer peripheral surface of the shell 11. The snare holding plate 19*b* sandwiches and holds the other end (the upper edge of the snare chord 14*c* situated on the right in FIG. 1(*b*)) of the other snare chord 14*c*. The lever 19*c* has a rotating mechanism and a locking mechanism so that by rotating the lever 19*c*, the player can adjust the tension of the snare wire 14, and by locking the lever 19*c*, the player can maintain the state in which the snare wire 14 is under tension.

For attaching the snare side head 13 to the lower portion (opening) of the shell 11, the user places the snare side head 13 so that the ends of the belt-like portion where there are no through-holes 13*c* on the head portion 13*a* will be aligned with the respective positions of the fixed strainer 18 and the movable strainer 19. The snare side head 13 should be attached to the shell 11 before the hoop 17*a* will be attached to the shell 11. For attaching the hoop 17*a* to the shell 11, a pair of through-holes provided on the hoop 17*a* will be aligned on the positions of the fixed strainer 18 and the movable strainer 19, respectively. Then, the snare wire 14 will be attached. More specifically, the snare wire 14 will be attached to the shell 11 so that the snare chords 14*c* passes through the pair of through-holes provided on the hoop 17*a* to be attached to the fixed strainer 18 and the movable strainer 19.

Figure 2:
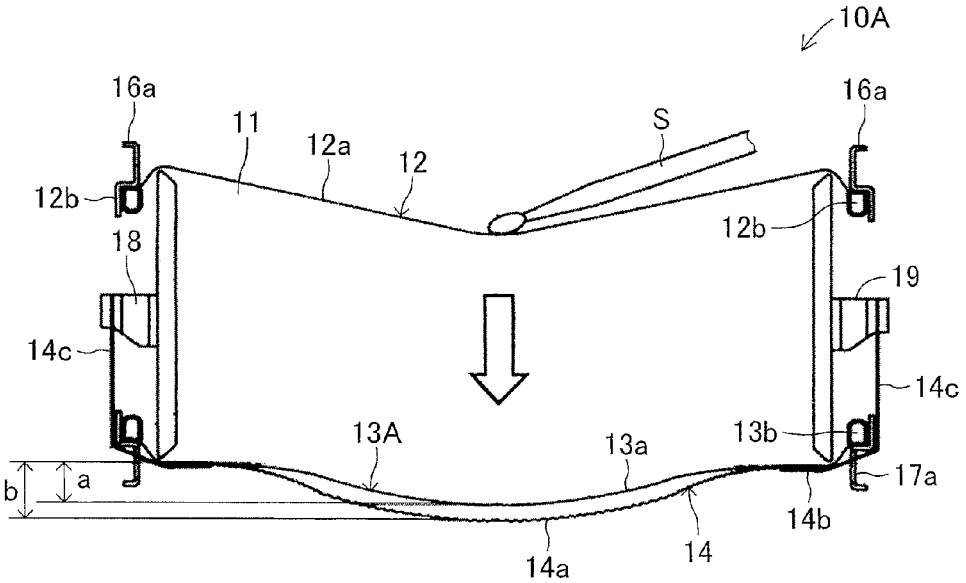
FIG. 2 describes behavior of a struck snare drum in order to explain effect on reduction in sound volume, and more specifically, FIG. 2(*a*) is an illustration of a conventional snare drum, and FIG. 2(*b*) is an illustration of the snare drum according to the first embodiment of the present invention.
Figure 2:
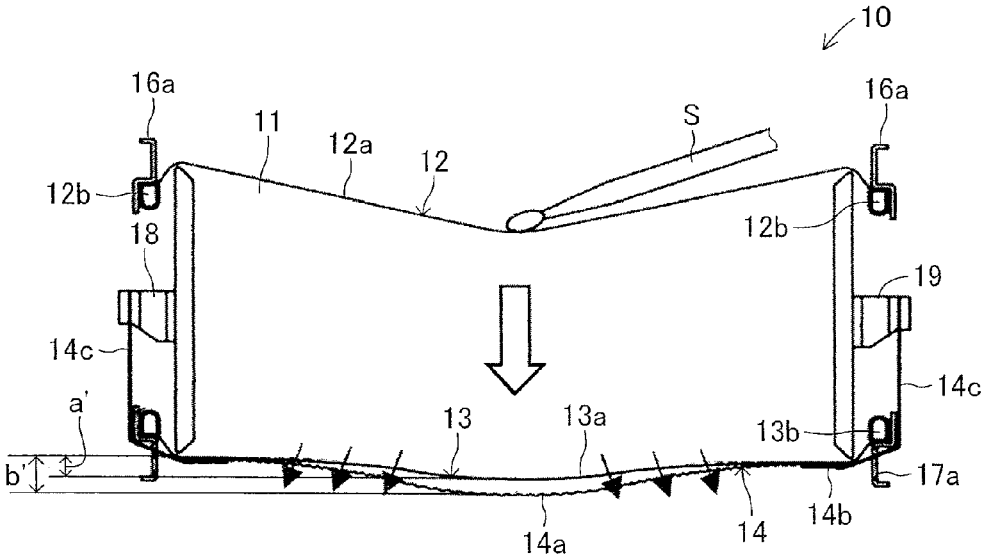

Compared with conventional snare drums having no through-holes 13*c*, the snare drum 10 configured as above can decrease sound volume generated by player's performance. Mechanisms of sound generation on the snare drum 10 and a conventional snare drum, and effects of decreasing sound volume will be explained with reference to FIGS. 2(*a*) and (*b*). FIG. 2(*a*) indicates a state where a conventional snare drum 10A is struck with a stick S, while FIG. 2(*b*) indicates a state where the snare drum 10 is struck with the stick S. FIGS. 2(*a*) and (*b*) are offered for explanation. Therefore, FIGS. 2(*a*) and (*b*) are described in detail differently from FIG. 1(*b*). The snare drum 10A does not have the through-holes 13*c* on a snare side head 13A. Except the absence of the through-holes 13*c*, however, the snare drum 10A is configured similarly to the snare drum 10. In FIG. 2(*a*), therefore, parts similar to those of the snare drum 10 are given numerals similar to those given in FIG. 2(*b*).

In response to a player's strike on the batter head 12 of the snare drum 10A and the snare drum 10 with the stick S, the batter head 12 is displaced and vibrates. As indicated by a heavy arrow in FIGS. 2(*a*) and (*b*), the displacement and vibration of the batter head 12 propagate through the air in the shell 11 to be conveyed as air and sound pressure to the snare side head 13A and the snare side head 13 placed on the lower part of the shell 11. The amounts of amplitude and conveyed air of the batter head 12 are identical between the snare drum 10A and the snare drum 10. The snare side heads 13A and 13 are displaced and vibrate downward by the air and sound pressure to push the snare wire 14 downward. The snare wire 14 is displaced downward, and is then displaced upward by recovering force of the coils 14*a* to collide against the snare side heads 13A and 13.

By the collision, vibration components including high frequencies are excited on the snare side heads 13A and 13 to produce timbre peculiar to snare drum. After the collision, the snare wire 14 is displaced downward again, and is then displaced upward to collide against the snare side heads 13A and 13. Then, the snare wire 14 repeats the collision against the snare side heads 13A and 13. The snare drums 10A and 10 are able to generate struck sound including high frequencies peculiar to snare drum by the interaction between the snare wire 14 and the snare side heads 13A and 13.

The sound volume is largely affected by the largest displacements of the snare side head 13A, 13 and the snare wire 14. In the case of the snare drum 10A, as indicated in FIG. 2(*a*), in response to a player's strike on the batter head 12 with the stick S, the air pressure is conveyed to the snare side head 13A in accordance with the displacement of the batter head 12. More specifically, the largest amplitude "a" of the snare side head 13A is determined according to the capacity of the shell 11, the largest displacement of the batter head 12 and the tension of the snare side head 13A and the snare wire 14. When the snare side head 13A is displaced, the snare wire 14 is pushed down so that the snare wire 14 will be displaced downward to the largest displacement "b".

In the case of the snare drum 10, as indicated in FIG. 2(*b*), in response to a player's strike on the batter head 12 with the stick S, the air pressure is conveyed to the snare side head 13 in accordance with the displacement of the batter head 12. More specifically, the air pressure is applied to the snare side head 13, so that the snare side head 13 is displaced, while as indicated by small arrows in FIG. 2(*b*), the air flows out from the through-holes 13*c* of the snare side head 13 to the outside to reduce the pressure in the shell 11.

Because of this phenomenon, the largest amplitude "a" of the snare side head 13 is reduced, compared to the largest amplitude "a" of the snare side head 13A. The reduced amplitude "a" results in decrease in the force by which the snare wire 14 of the snare drum 10 is pushed down. As a result, the largest displacement "b" of the snare wire 14 of the snare drum 10 is also smaller than the largest displacement "b" of the snare wire 14 of the snare drum 10A.

As described above, because the through-holes 13*c* are provided on the snare side head 13 of the snare drum 10, the largest amplitude "a" of the snare side head 13 of the snare drum 10 and the largest displacement "b" of the snare wire 14 of the snare drum 10 are smaller than the largest amplitude "a" of the snare side head 13A and the largest displacement "b" of the snare wire 14 of the snare drum 10A. Because of the reduced largest amplitude "a" and largest displacement "b", therefore, the sound volume of the snare drum 10 is reduced. Furthermore, the timbre of the snare drum 10 is determined according to the vibration of the batter head 12, the vibration of the snare side head 13 and the sound generated by the collision of the snare wire 14 against the snare side head 13. By decreasing the vibration of the snare side head 13 and the sound pressure level of the sound generated by the collision of the snare wire 14 against the snare side head 13 to be lower than those of the snare drum 10A, the snare drum 10 can generate struck sound whose timbre is similar to the timbre of the snare drum 10A but whose sound volume is reduced.

Figure 3:
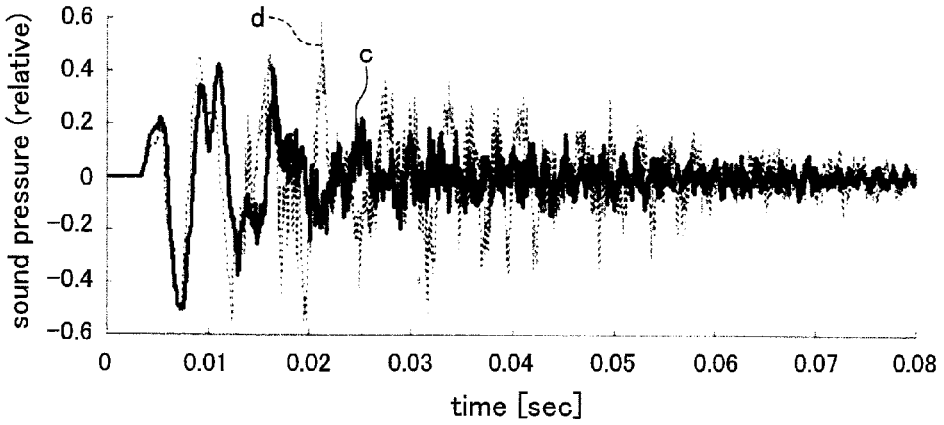
FIG. 3 is a graph comparing the magnitude of sound pressure with respect to elapsed time from a strike between the conventional snare drum and the snare drum according to the first embodiment of the present invention.

FIG. 3 indicates waveforms representing changes in sound pressure of a struck sound generated by the snare drum 10 and the snare drum 10A with respect to elapsed time. In FIG. 3, a solid line "c" indicates a struck sound of the snare drum 10, while a broken line "d" indicates a struck sound of the snare drum 10A. As apparent from FIG. 3, the initial waveform of the solid line "c" is approximately similar to that of the broken line "d". More specifically, from the strike on the batter head 12 until generation of a struck sound by the interaction caused by the collision of the snare wire 14 against the snare side head 13, there is no difference in struck sound between the snare drum 10 and the snare drum 10A. After the generation of a struck sound, the sound pressure represented by the solid line "c" is lower than the sound pressure represented by the broken line "d", which indicates reduced sound volume in the solid line "c". However, lines described by peaks of the solid line "c" and the broken line "d" are approximately parallel straight lines, which indicates that the sustained length of the solid line "c" represents natural reverberation which is similar to that represented by the broken line "d". In other words, the decay of the solid line "c" has the same envelope as that of the broken line "d".

Figure 4:
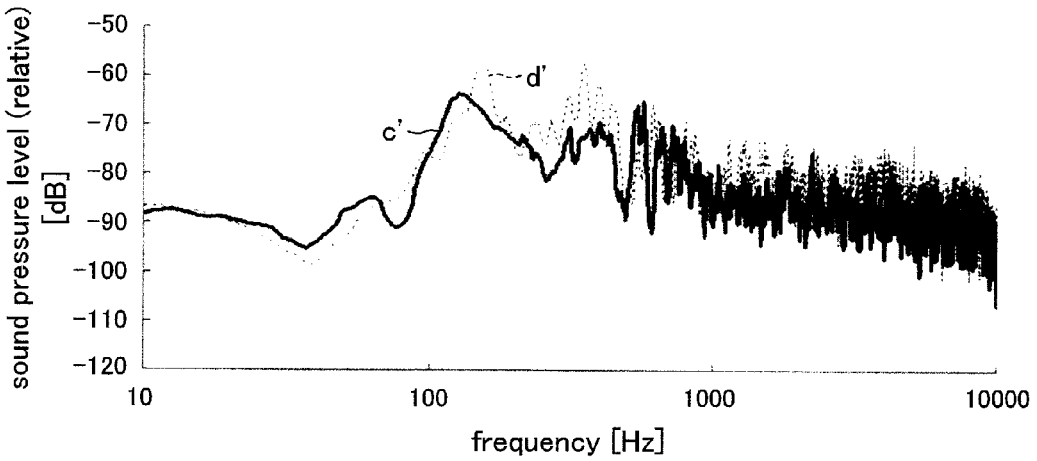
FIG. 4 is a graph comparing the magnitude of sound pressure with respect to frequency of a struck sound between the conventional snare drum and the snare drum according to the first embodiment of the present invention.

FIG. 4 indicates changes in sound pressure level of a struck sound of the snare drum 10 and the snare drum 10A with respect to frequency. In FIG. 4, a solid line "c" indicates sound generated on the snare drum 10, while a broken line "d" indicates sound generated on the snare drum 10A. FIG. 4 indicates that the solid line "c" represents decrease in sound pressure energy in a wide range of frequencies including low frequencies and high frequencies, compared to the broken line "d". Compared to the sound generated on the snare drum 10A, as described above, because the sound generated on the snare drum 10 behaves similarly to the sound generated on the snare drum 10A in initial behavior, the timbre of the sound generated on the snare drum 10 resembles the timbre of the sound generated on the snare drum 10A. As for the snare drum 10, with importance being given not to decaying struck sound but to decreasing amplitude level, the sound volume is decreased. Therefore, the sustained length is natural similarly to that of the snare drum 10A.

As described above, the snare drum 10 according to the embodiment has no through-holes on the batter head 12 but has the through-holes 13*c* only on the snare side head 13. Therefore, keeping player's feeling and touch of striking the batter head 12 similar to those provided by the snare drum 10A and keeping timbre similar to that of the snare drum 10A, the snare drum 10 according to the embodiment can decrease only sound volume. Furthermore, because the batter head 12 has no through-holes, the durability of the batter head 12 of the snare drum 10 will not be degraded. Furthermore, sound generated by the collision of the snare wire 14 against the snare side head 13 of the snare drum 10 and sustain can be secured on the snare drum 10 as in the case of the snare drum 10A.

Because the through-holes 13*c* on the snare side head 13 are provided on the area excluding a region corresponding to the snare wire 14, the snare drum 10 of this embodiment can avoid degradation in durability of the snare side head 13 caused by collision of the snare wire 14 against the area of the snare side head 13 where the through-holes 13 are provided. Furthermore, because the through-holes 13*c* are designed to have a diameter of 3 mm while the through-hole rate with respect to the snare side head 13 (the head portion 13*a*) is 2%, the embodiment realizes the favorable snare drum 10 which can generate natural timbre of snare drum. Therefore, the snare drum 10 is preferable as a musical instrument for actual musical performance. In addition, it is needless to say that the snare drum 10 is suitable for practice.

Second Embodiment

Figure 5:
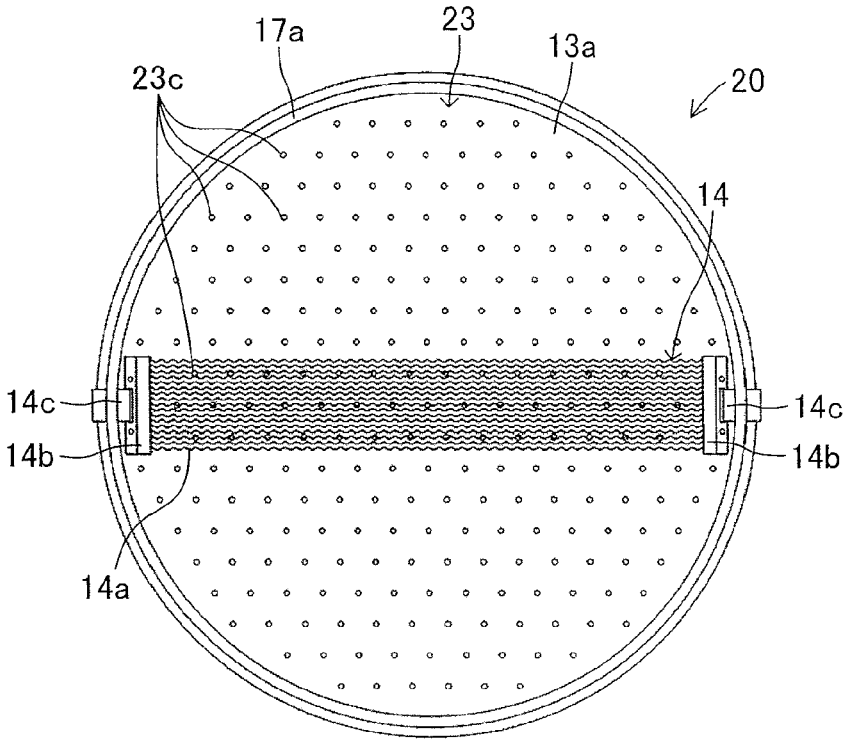
FIG. 5 is a bottom view of a snare drum according to the second embodiment of the present invention.

FIG. 5 indicates a bottom surface of a snare drum 20 according to the second embodiment of the present invention. The snare drum 20 has circular through-holes 23*c* all over a snare side head 23. The through-holes 23*c* have the same diameter and pitch as those of the above-described through-holes 13*c*. Except the through-holes 23*c*, the snare drum 20 is configured similarly to the above-described snare drum 10. Therefore, similar components are given similar numerals to omit explanations of the components.

As for the snare drum 20, because the through-holes 23*c* are provided all over the snare side head 23, the durability of the snare side head 23 is reduced, but the entire surface of the snare side head 23 can be used to decrease the sound volume. In addition, the snare drum 20 eliminates necessity for the user to care about the direction of the snare side head 23 for attaching the snare side head 23 to the shell 11. Therefore, the snare drum 20 facilitates installation of the snare side head 23 on the shell 11. The operational advantage of the snare drum 20 other than the above is the same as that of the snare drum 10.

Figure 6:
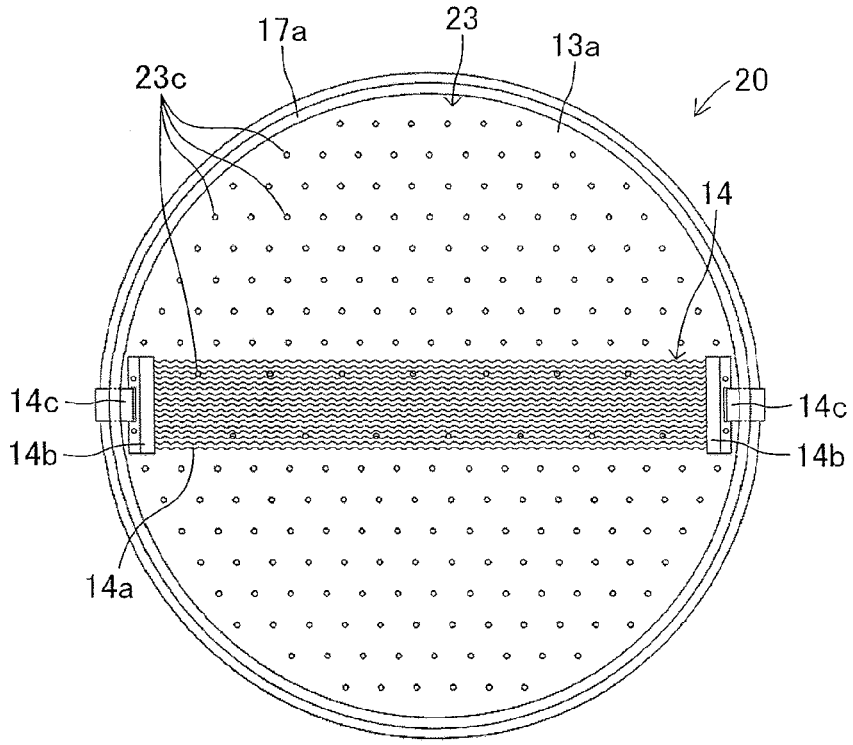
FIG. 6 is a bottom view of a snare drum according to a modification of the second embodiment of the present invention.
Figure 7:
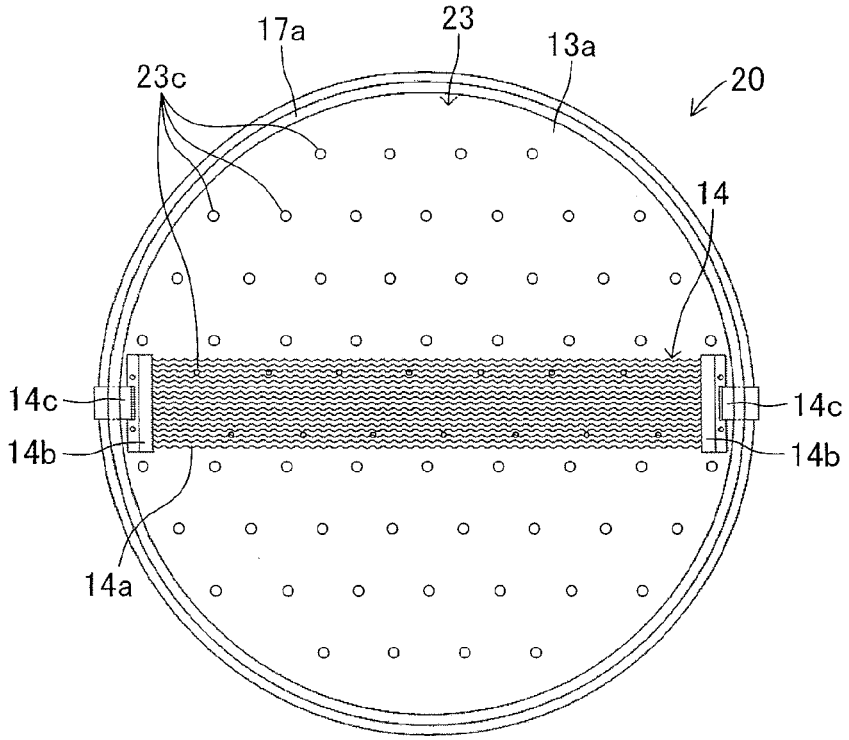
FIG. 7 is a bottom view of a snare drum according to another modification of the second embodiment of the present invention.

As shown in FIG. 6, the snare drum 20 of the second embodiment may be modified such that the through-holes 23*c* provided on an area which extends in a radial direction through the midpoint of the snare side head 23 to face the snare wire 14 and has a width approximately equal to the width of the snare wire 14 are less dense than the through-holes 23*c* provided on the other areas. Alternatively, as shown in FIG. 7, the snare drum 20 of the second embodiment may be modified such that the through-holes 23 provided on the area which extends in a radial direction through the midpoint of the snare side head 23 to face the snare wire 14 and have a width approximately equal to the width of the snare wire 14 have a diameter which is smaller than the diameter of the through-holes 23*c* provided on the other areas. The snare drum 20 of these modifications can obtain middle effects on the reduction in sound volume and the durability between the snare drum 10 and the snare drum 20.

Third Embodiment

Figure 8:
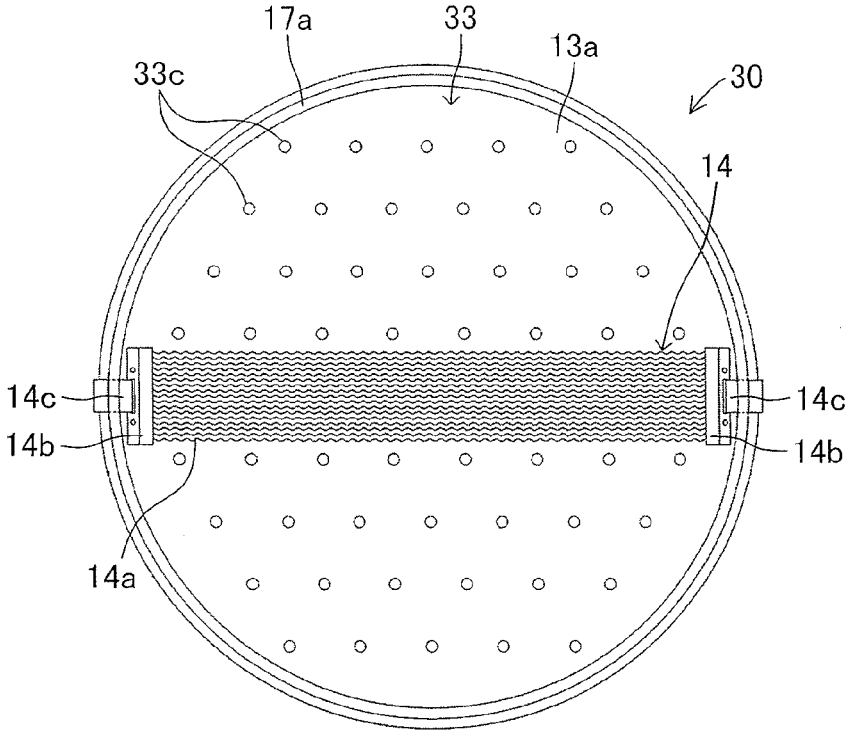
FIG. 8 is a bottom view of a snare drum according to the third embodiment of the present invention.

FIG. 8 indicates a bottom surface of a snare drum 30 according to the third embodiment of the present invention. The snare drum 30 has circular through-holes 33*c* which is provided on a snare side head 33 and whose diameter and pitch are larger than the above-described through-holes 13*c* but have the same through-hole rate as the through-holes 13*c*. In other words, the through-holes 33*c* have a larger diameter than the diameter of the through-holes 13*c*, while the number of the through-holes 33*c* is reduced in proportion to the enlarged diameter. Except the through-holes 33*c*, the snare drum 30 is configured similarly to the above-described snare drum 10. Therefore, similar components are given similar numerals to omit explanations of the components.

The snare drum 30 have the through-holes 33*c* having a larger diameter, which facilitates outflow of air. As a result, the amplitude of the snare drum 30 is lower than the amplitude of the above-described snare drum 10. In other words, the snare drum 30 realizes efficiently reduced amplitude by employing the enlarged through-holes in spite of the same through-hole rate. The operational advantage of the snare drum 30 other than the above is the same as that of the snare drum 10. As a modification of the snare drum 30 of the third embodiment, the snare side head 33 may have the through-holes 33*c* on an area which faces the snare wire 14.

Fourth Embodiment

Figure 9:
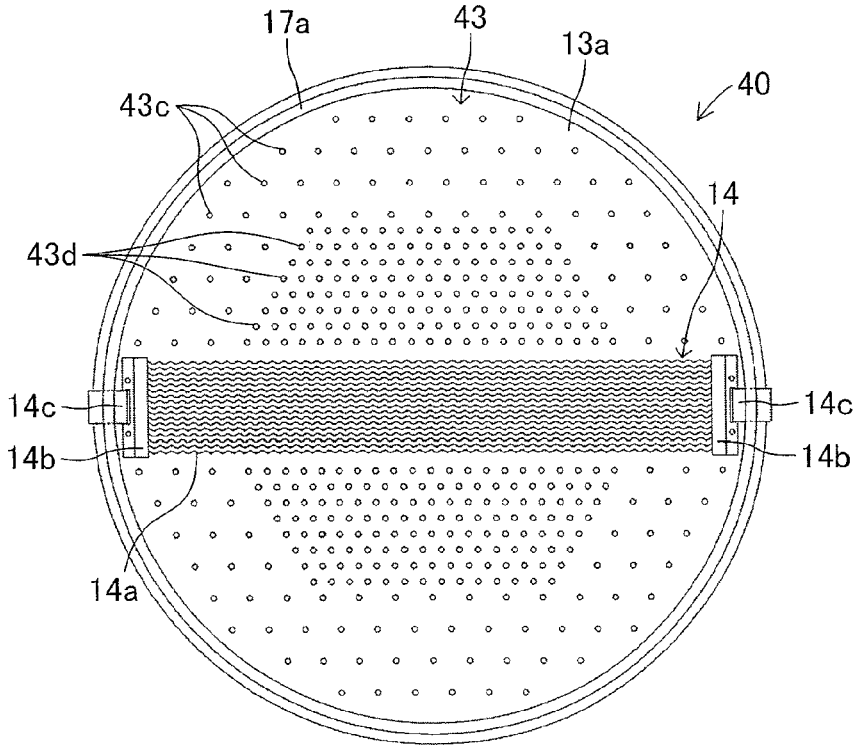
FIG. 9 is a bottom view of a snare drum according to the fourth embodiment of the present invention.

FIG. 9 indicates a bottom surface of a snare drum 40 according to the fourth embodiment of the present invention. A snare side head 43 of the snare drum 40 has large circular through-holes 43*c* and small circular through-holes 43*d*. The through-holes 43*c* have the same diameter and pitch as those of the above-described through-holes 13*c* of the first embodiment. The through-holes 43*c* are provided on an outer area of the snare side head 43. The diameter and the pitch of the through-holes 43*d* are shorter than those of the through-holes 43*c*. The through-holes 43*d* are arranged to form symmetrical two trapezoids on the center of the snare side head 43 with a space being provided between the trapezoids. The area made up by the through-holes 43*d* placed at the central portion is approximately circular whose diameter is 64% of the snare side head 43. Except the through-holes 43*c* and the through-holes 43*d*, the snare drum 40 is configured similarly to the above-described snare drum 10. Therefore, similar components are given similar numerals to omit explanations of the components.

The snare drum 40 reduces amplitude more than the snare drum 10. By providing a multiplicity of through-holes 43*d* on the central portion of the snare side head 43, more specifically, the snare drum 40 can efficiently decrease amplitude. The operational advantage of the snare drum 40 other than the above is the same as that of the snare drum 10. The snare drum 40 of the fourth embodiment may be modified such that the through-holes 43*c* and the through-holes 43*d* have the same diameter but have their respective pitches indicated in FIG. 9 so that the through-holes placed on the central portion of the snare side head 43 are denser than the outer through-holes. As a different modification, the snare drum 40 may be modified such that the snare side head 43 has the through-holes 43*c* and the through-holes 43*d* on an area as well which faces the snare wire 14. The fourth embodiment is designed such that the central area where the through-holes 43*d* are provided is approximately circular and has a diameter which is 64% of the snare side head 43. However, it is preferable that the diameter of the central area is 40% or more of the snare side head 43.

Fifth Embodiment

Figure 10:
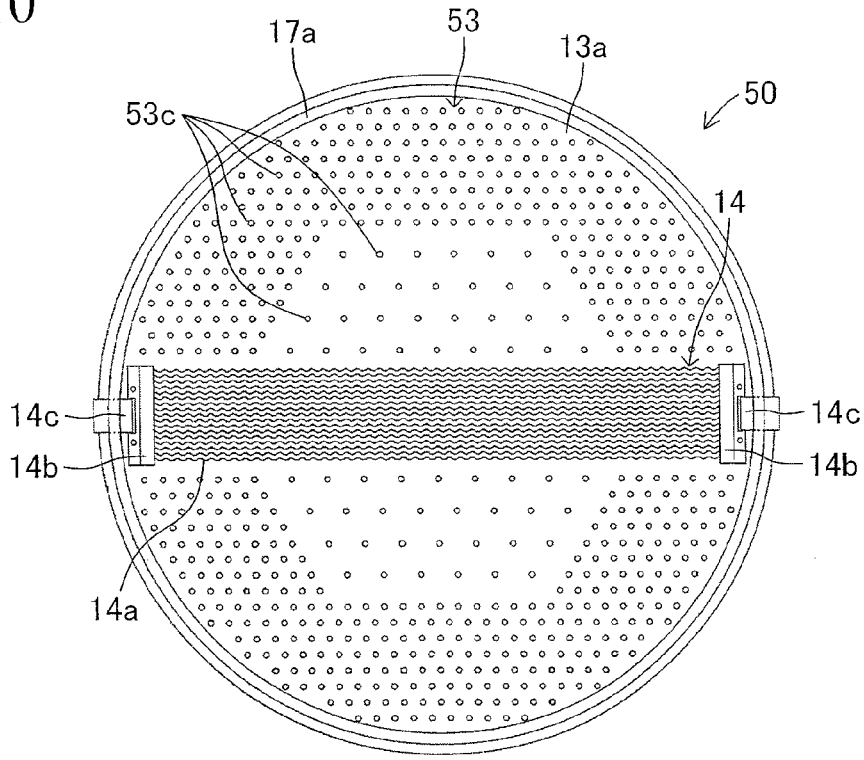
FIG. 10 is a bottom view of a snare drum according to the fifth embodiment of the present invention.

FIG. 10 indicates a bottom surface of a snare drum 50 according to the fifth embodiment of the present invention. The snare drum 50 is designed such that the pitch of circular through-holes 53*c* provided on an outer area of a snare side head 53 is shorter than the pitch of the through-holes 53*c* provided on a central portion of the snare side head 53. Therefore, the outer area has more through-holes 53*c* than the central portion of the snare side head 53.

The diameter of the through-holes 53*c* and the pitch of the through-holes 53*c* provided on the central portion of the snare side head 53 are the same as the diameter and the pitch of the through-holes 13*c*, while the pitch of the through-holes 53*c* provided on the outer area of the snare side head 53 is shorter than the pitch of the through-holes 13*c*. In this embodiment as well, the through-holes 53*c* provided on the central portion are arranged to form symmetrical two trapezoids with a space being provided between the trapezoids. In this case as well, furthermore, an area made up by the through-holes 53*c* of the central portion is nearly a circle whose diameter is 64% of the snare side head 53. Except the through-holes 53*c*, the snare drum 50 is configured similarly to the above-described snare drum 10. Therefore, similar components are given similar numerals to omit explanations of the components.

The snare drum 50 can achieve amplitude reduction similarly to the snare drum 10 because the through-holes 53*c* of the central portion are similar to the through-holes of the snare drum 10. Furthermore, the through-holes 53*c* provided on the outer area have more holes than the through-holes 13*c* provided on the counterpart of the snare drum 10. Therefore, the snare drum 50 can efficiently reduce amplitude of the outer peripheral head which is more likely to contain harmonics. By increasing the number of holes provided on the outer area, in other words, the snare drum can not only realize reduction in sound volume but also vary timbre. The operational advantage of the snare drum 50 other than the above is the same as that of the snare drum 10. As a modification of the snare drum 50 of the fifth embodiment, the diameter of the through-holes 53*c* may vary between the central portion and the outer area. As a different modification, furthermore, the snare side head 53 may have the through-holes 53*c* on an area which faces the snare wire 14.

By using a desired one of the snare side heads 13, 23, and so on of the above-described embodiments, the user can have the snare drum 10 which can generate user's desired sound. Furthermore, the user may prepare different types of snare side heads 13, 23 and so on so that the user can change the snare side head of the user's snare drum to have the most suitable snare side head. As a result, the snare drum 10 can be rich in expression. The snare drum according to the present invention is not limited to the above-described embodiments but can be variously modified within the technical scope. For example, the snare drum 10, 20, 30, 40, 50 may have a small minority of through-holes on the batter head 12 so that the through-holes do not exert influence on player's feeling and touch of striking the batter head 12, timbre and sustain of sound of the snare drum 10, 20, 30, 40, 50, and so on.

What is claimed is:

1. A snare drum comprising:

a hollow cylindrical shell;

a batter head mounted on one end of the hollow cylindrical shell;

a snare side head mounted on the other end of the hollow cylindrical shell, the snare side head having a plurality of through-holes; and a snare wire covering a first area of the snare side head and being adapted to vibrate on the snare side head, the through-holes being provided only on the first area of the snare side head.

2. The snare drum according to claim 1, wherein the batter head has no through-holes.

3. The snare drum according to claim 1, wherein the through-holes are arranged in a triangular lattice pattern.

4. A snare drum comprising:

a hollow cylindrical shell;

a batter head mounted on one end of the hollow cylindrical shell;

a snare side head mounted on the other end of the hollow cylindrical shell, the snare side head having a plurality of through-holes; and a snare wire covering a first area of the snare side head and adapted to vibrate on the snare side head, the through-holes including a first group of through-holes provided on the first area of the snare side head and a second group of through-holes provided on another area of the snare side head, a density or a diameter of the first group of through-holes being different from a density or diameter, respectively, of the second group of through-holes.

5. The snare drum according to claim 4, wherein the batter head has no through-holes.

6. The snare drum according to claim 4, wherein the through-holes are arranged in a triangular lattice pattern.

7. A snare drum comprising:

a hollow cylindrical shell;

a batter head mounted on one end of the hollow cylindrical shell;

a snare side head mounted on the other end of the hollow cylindrical shell, the snare side head having a plurality of through-holes, the snare side head having a center area and an outer area, a density or a diameter of the through-holes provided on the center area being different from a density or diameter, respectively, of through-holes provided on the outer area; and a snare wire located adjacent the snare side head and adapted to vibrate on the snare side head.

8. The snare drum according to claim 7, wherein the batter head has no through-holes.

9. The snare drum according to claim 7, wherein the through-holes are arranged in a triangular lattice pattern.

* * * * *